US006045412A

United States Patent [19]

Guanco et al.

[11] Patent Number: 6,045,412

[45] Date of Patent: Apr. 4, 2000

[54] POWER DISTRIBUTION CENTER WITH TERMINAL HOLDER

[75] Inventors: Andre Esper Guanco, Farmington Hills; Hiroshi Umemoto, Beverly Hills, both of Mich.

[73] Assignee: Yazaki Corporation, Tokyo, Japan

[21] Appl. No.: 08/965,772

[22] Filed: Nov. 25, 1997

[51] Int. Cl.[7] ..... H01R 13/436

[52] U.S. Cl. ..... 439/752

[58] Field of Search ..... 439/752

[56] References Cited

U.S. PATENT DOCUMENTS

| | | | |
|---|---|---|---|
| 4,772,229 | 9/1988 | Nix et al. | 439/752 |
| 5,098,315 | 3/1992 | Scowen | 439/752 |
| 5,252,096 | 10/1993 | Okada | 439/752 |
| 5,257,951 | 11/1993 | Maeda | 439/752 |
| 5,755,600 | 5/1998 | Yoshida | 439/752 |

*Primary Examiner*—Gary F. Paumen
*Attorney, Agent, or Firm*—Young & Basile, P.C.

[57] ABSTRACT

A power distribution center for an automotive vehicle electrical system comprises a junction block having a plurality of receptacles formed on an upper surface thereof to receive electrical components such as fuses and relays, and a holder insertable into engagement with the junction block to retain electrical terminals properly positioned within the junction block to make contact with the electrical components. A rectangular gap is formed in a side wall of the junction block. Passages extend from a recessed surface within the gap into the junction block. The terminal holder has arms which are inserted into the passages to engage the terminals and inhibit downward movement thereof, and an end plate which fits into the gap. The terminal holder end plate is configured to fit into the gap such that the outer surface of the end plate substantially matches the contours of the side wall and effectively seals off the openings of the passages in the gap. An upper housing fits downwardly over the top surface of the junction block such that a peripheral edge of the housing surrounds the upper edge of the side wall and also the upper portion of the terminal holder end plate to complete the sealing of the passages.

5 Claims, 4 Drawing Sheets

POWER DISTRIBUTION CENTER WITH TERMINAL HOLDER

FIELD OF THE INVENTION

This invention relates to power distribution centers for automotive vehicles, and more specifically to a power distribution center having a holder for securing electrical terminals in place within the power distribution center and preventing the intrusion of contaminants into the center.

BACKGROUND OF THE INVENTION

Power distribution centers (PDCs) are commonly used in automotive vehicles to simplify electrical system wiring by eliminating multi-branch wiring and consolidating fuses, relays, and other electrical components in a single location. A PDC is often mounted within the vehicle's engine compartment and typically comprises a junction block having a plurality of receptacles disposed on a mounting surface for receiving electrical connectors, fuses, relays, and other components. Electrical terminals are retained within chambers internal to the junction block beneath the receptacles such that the electrical components make contact with the terminals when they are inserted into their respective receptacles. The PDC often has one or more removable housings to protect the junction block, the electrical components and the terminals from contaminants such as dirt, water, salt and other debris that may be present in the vehicle engine compartment.

Typically, assembly of the PDC involves inserting the electrical terminals into the chambers from the underside of the junction block. It is necessary that the terminals be securely retained in the chambers so that they are not pushed downward when the electrical components are inserted into the receptacles, as this will prevent proper contact between the components and the terminals.

U.S. Pat. No. 5,257,951 discloses apparatus for securing electrical terminals within a junction block. As seen in FIGS. 5 and 6, the junction block 100 has a series of receptacles 102 disposed in a straight line on an upper surface and chambers 104 defined by chamber walls 106 molded integrally with the junction block below the surface. Three parallel passages 108 extend into the junction block 100 and communicate with each of the chambers 104 in the line. A terminal holder 110 comprises three arms 112 extending in parallel from an end plate 114. After the terminals 116 have been inserted into their respective chambers 104, the holder arms 112 are inserted into the passages 108. As seen in FIG. 6, the two lower arms pass beneath shoulders of the terminals to prevent downward movement, and the third arm passes between adjacent terminals to urge flexible walls 118 separating the terminals from one another toward positions tending to hold the terminals in place. The terminal holder disclosed in the '951 patent has been found to provide inadequate protection against entry of contaminants into the passages into which the holder arms are inserted. Since the passages offer direct access to the terminal chambers, any penetration by contaminants could cause corrosion of the terminals and have a detrimental effect upon the electrical connections within the junction block.

FIGS. 7 and 8 depict a prior art PDC which provides; improved protection against entry of contaminants into the passages. The PDC comprises a junction block 120, a terminal holder 122, and top and bottom housings 124,126 for the junction block. A row of receptacles 128 is formed in the upper surface of the junction block for receiving electrical components (not shown) such as fuses or relays.

Chambers 130 for housing electrical terminals 132 are formed integrally with the block directly below and in communication with the receptacles 128.

The junction block has a side wall 134 extending downwardly from the upper surface, and a rectangular gap 136 is formed in the side wall adjacent the end of the row of receptacles such that the openings of the passages 121 are recessed inwardly from the surface of the side wall. The terminal holder 122 is substantially identical to the holder 114 described hereinabove with reference to the '951 patent, and when the arms 138 thereof are inserted fully into the passages 121, the end plate 140 fits into the gap 136 such that the outermost surface of the end plate is recessed inwardly from the outer surface of the junction block side wall 134, as best seen in the cross-sectional view of FIG. 8.

Lower housing 126 has a first tab 142 extending upwardly from an upper edge thereof at a position which coincides with the gap 136 in the junction block side wall 134. Upper housing 124 has an outwardly flared skirt 154 forming its lower edge, and a second tab 156 projects downwardly from the skirt at a position which coincides with the gap in the junction block side wall.

After the terminal holder 122 has been inserted fully into the junction block 120, the lower housing 126 is mated with the junction block to cover the lower surface thereof. The upper edge of the housing fits inside of the junction block side wall and the lower tab passes upwardly on the inside of the side wall 134 to cover the lower portion of the terminal holder end plate 140, trapping the holder in the fully inserted position, as seen in FIG. 8. The lower housing 126 is maintained in connection with the junction block 120 by mating latch members on the two pieces, as is well known in the art. The upper housing 124 is then mated with the junction block 120 such that the skirt 154 fits downwardly over and surrounds the top edge of the side wall 134, the second tab 156 fitting into the upper portion of the gap 136 and overlapping the lower tab 142 by a small distance. Accordingly, the two tabs 142,156 cover the terminal holder end plate 140 and so provide improved protection against the intrusion of contaminants into the passages.

The presence of the tabs on the upper and lower housings,, however, has been found to make it more difficult to property assemble the housings with the junction block. Specifically, in some PDCs the upper housing is attached to the junction block by first engaging one edge of the housing with the junction block and then tipping or rotating the housing downwardly toward the upper surface of the block in a hinging-type movement about that edge until the entire housing is properly positioned and secured to the block. If, as may often be the case, the tab on the upper housing is located on an edge which is perpendicular to the hinge edge, the tab does not follow a straight path as it fits into the gap but rather travels in an arcuate path during the hinging movement. Accordingly, the lower corners of the tab will strike the side wall rather than fitting smoothly into the gap, interfering with closing of the housing.

Further, the tabs are quite thin and flexible and so are subject to being inadvertently bent to configurations that may prevent them from fitting properly into their respective gaps. If the tabs are not positioned properly with respect to the gap when mating of the housings is attempted, they may bend or break when the housings are assembled with the junction block, thereby providing inadequate protection against contamination. Bending of the tabs may also prevent proper assembly of the housings with the junction block.

SUMMARY OF THE INVENTION

It is an object of this invention to provide a power distribution center wherein a terminal holder is matable with an opening in the side wall of junction block to simply and effectively seal the opening against the intrusion of contaminants.

A still further object of this invention is to eliminate the need for sealing provision for the holder on upper and lower housings of a junction block, so that the housings are more easily fabricated and assembled with the junction block.

In the illustrative embodiment of the invention disclosed herein, a junction block has a plurality of receptacles formed in a straight line on an upper surface thereof to receive electrical components such as fuses, relays and electrical connectors. Electrical terminals are disposed in chambers formed within the junction block immediately below the receptacles such that the electrical components are placed in electrical connection with the terminals when they are inserted into the receptacles. An upper housing is securable over the upper surface of the junction block to protect the block and electrical components, and a lower housing is securable to the junction block to protect the lower surface.

A rectangular gap is formed in a side wall of the junction block adjacent the end of the line of receptacles, and passages extend from a recessed surface within the gap into the junction block. The passages communicate with the terminal chambers.

A terminal holder comprises an end plate configured to fit into the gap in the side wall and a plurality of arms connected to and projecting from the end plate for insertion into the passages when the end plate is positioned in the gap. When inserted into the passages, the arms engage one or more of the terminals to inhibit downward movement of the terminals within their chambers when an electrical component is inserted into the receptacle to contact the terminal.

According to a feature of the invention, the end plate is configured such that it fits complementally into the gap, its outer surface matching the contours of the side wall and effectively sealing off the openings of the passages in the gap. The upper housing fits downwardly over the top surface of the junction block such that a peripheral edge of the housing surrounds the upper edge of the side wall and also the upper portion of the terminal holder end plate. In doing so, the upper housing completes the sealing of the passages into the junction block, and also prevents movement of the holder outwardly from the fully inserted position.

According to another feature of the invention, the side wall comprises a substantially flat lower section and an upper section which is parallel to and inset slightly from the lower section to form a step, and the end plate has an upper portion and a lower portion which are substantially parallel and offset from one another to form a second step. When the terminal holder is fully inserted into the junction block, the upper portion of the end plate fits flush with the upper section of the side wall, the lower portion of the end plate fits flush with the lower section of the side wall, and the step in the end plate is aligned with the step separating the upper and lower sections of the side wall. The skirt of the upper housing then fits downwardly over the upper section of the side wall and the upper portion of the end plate to effectively seal the passages.

DETAILED DESCRIPTION OF THE PREFERRED EMBODIMENT

Referring now to FIGS. 1–4, a power distribution center (PDC) 10 according to the present invention is shown to comprise a junction block 12, an upper housing 14, a lower housing 16 and a terminal holder 18. All of the components are preferably formed of injection molded thermoplastic.

Figure 2:
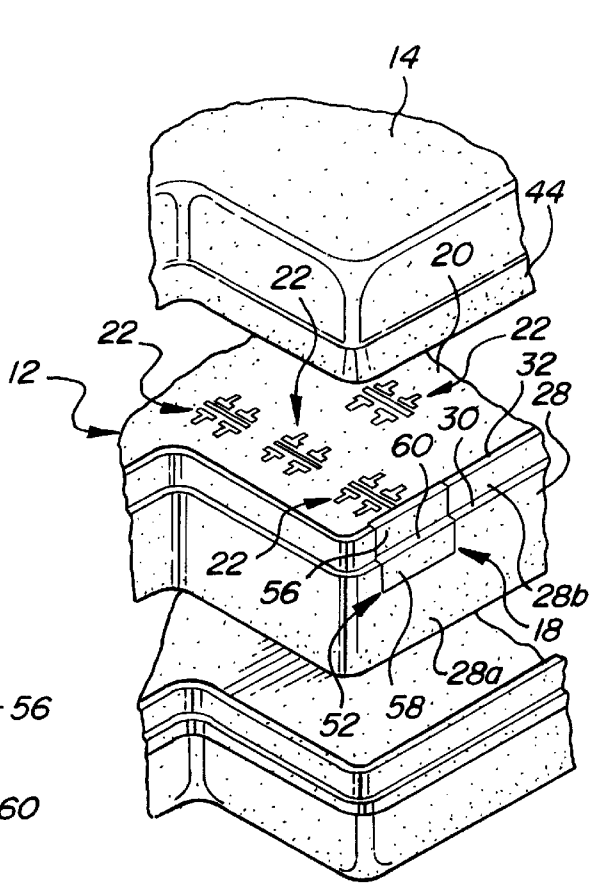
FIG. 2 is the PDC of FIG. 1 with the terminal holder inserted into the unction block.
Figure 1:
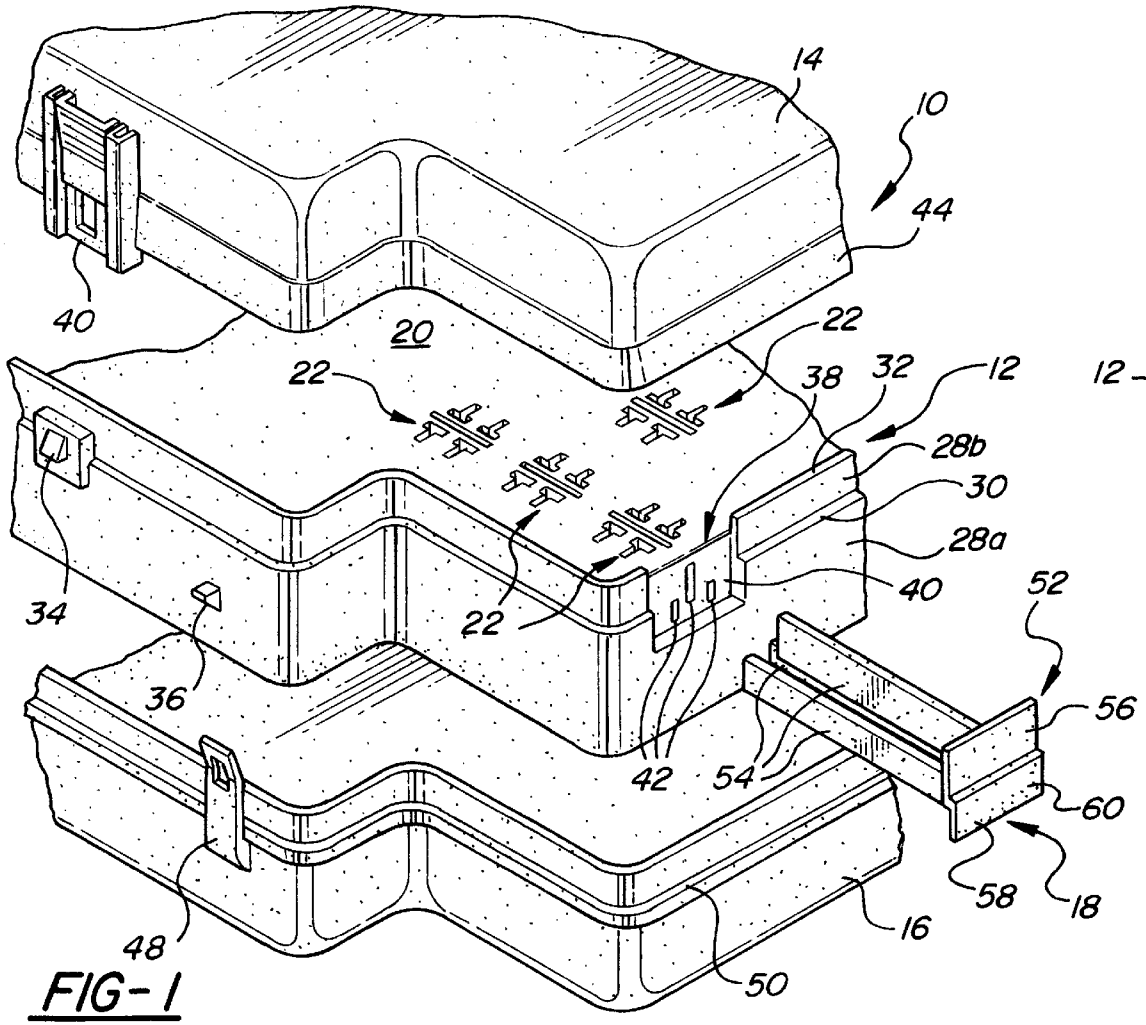
FIG. 1 is a perspective view of a power distribution center according to the present invention before assembly.
Figure 4:
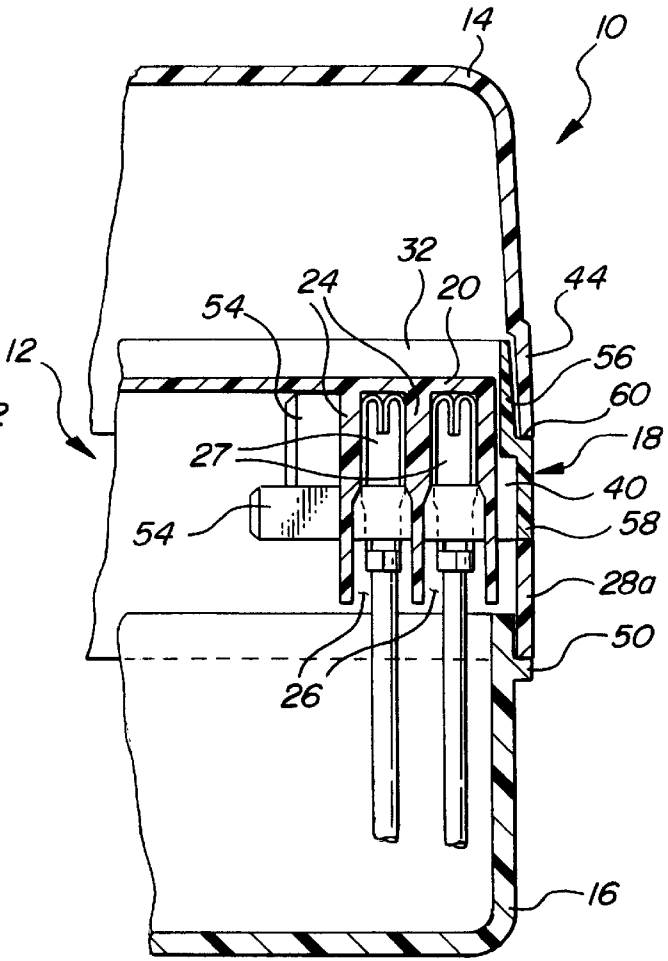
FIG. 4 is a cross-sectional view taken along lines 4—4 in FIG. 3.
Figure 3:
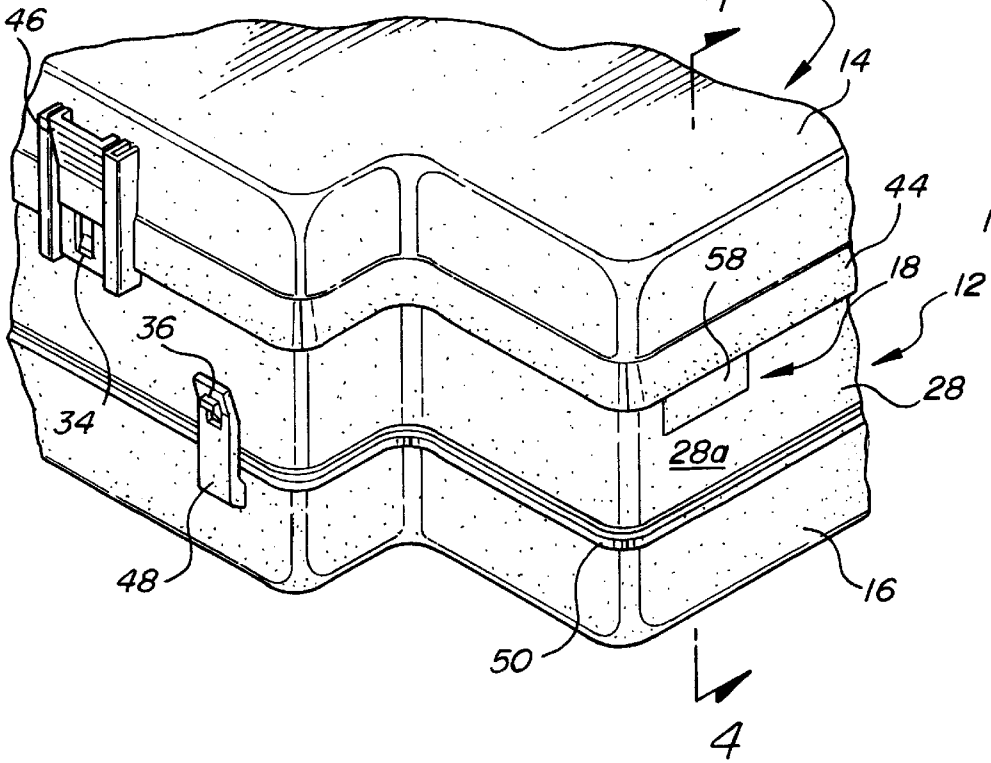
FIG. 3 is a perspective view of the invention power distribution center in a fully assembled condition.
Figure 5:
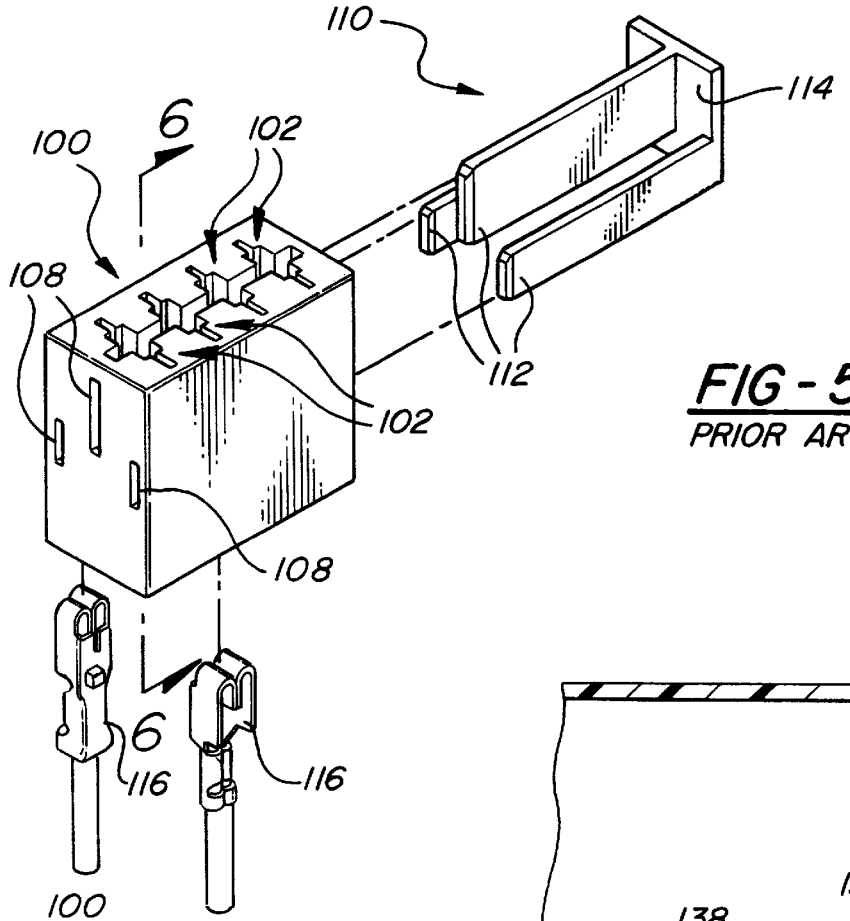
FIG-5 PRIOR ART
FIG. 5 is a perspective view of a prior art junction block and terminal holder.
Figure 6:
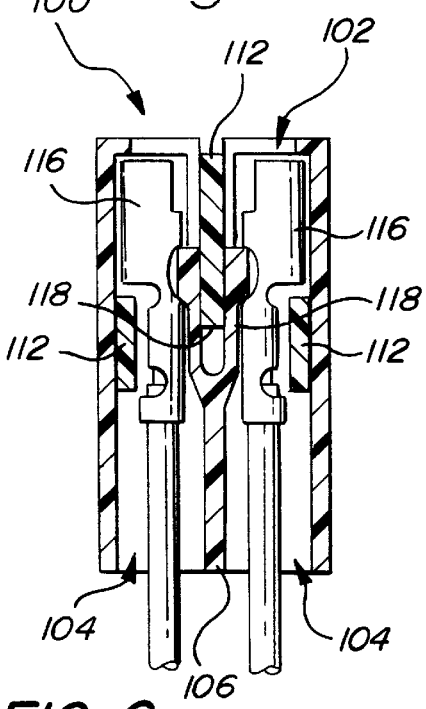
FIG-6 PRIOR ART
FIG. 6 is a cross-sectional view taken along lines 6—6 of FIG. 5.
Figure 8:
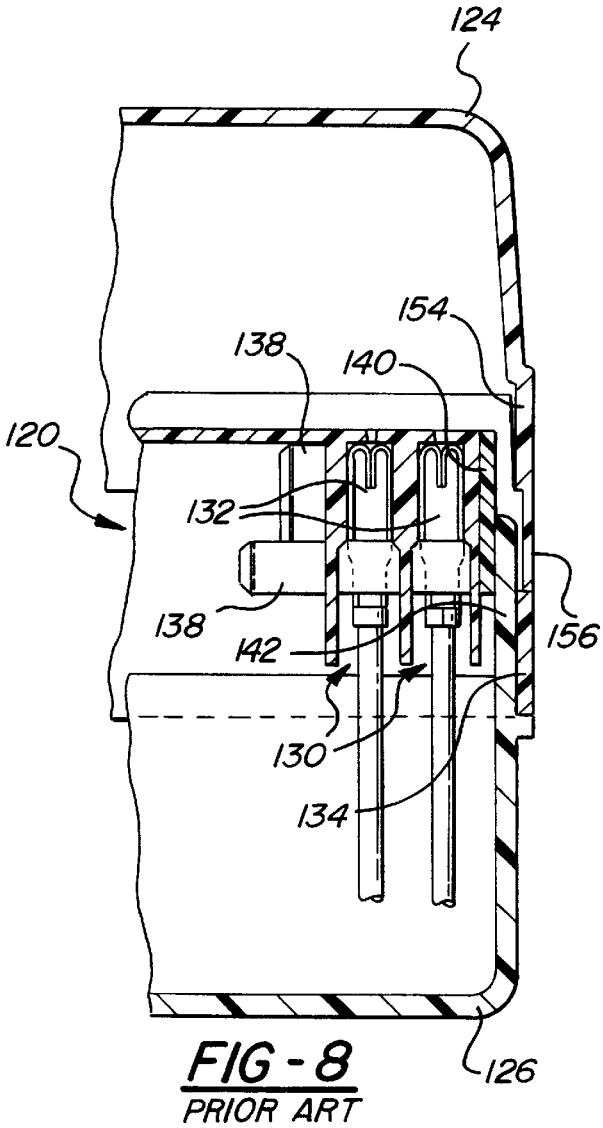
FIG-8 PRIOR ART
FIG. 8 is a cross-sectional view of the prior art power distribution center in an assembled condition, as viewed along lines 8—8 of FIG. 7.
Figure 7:
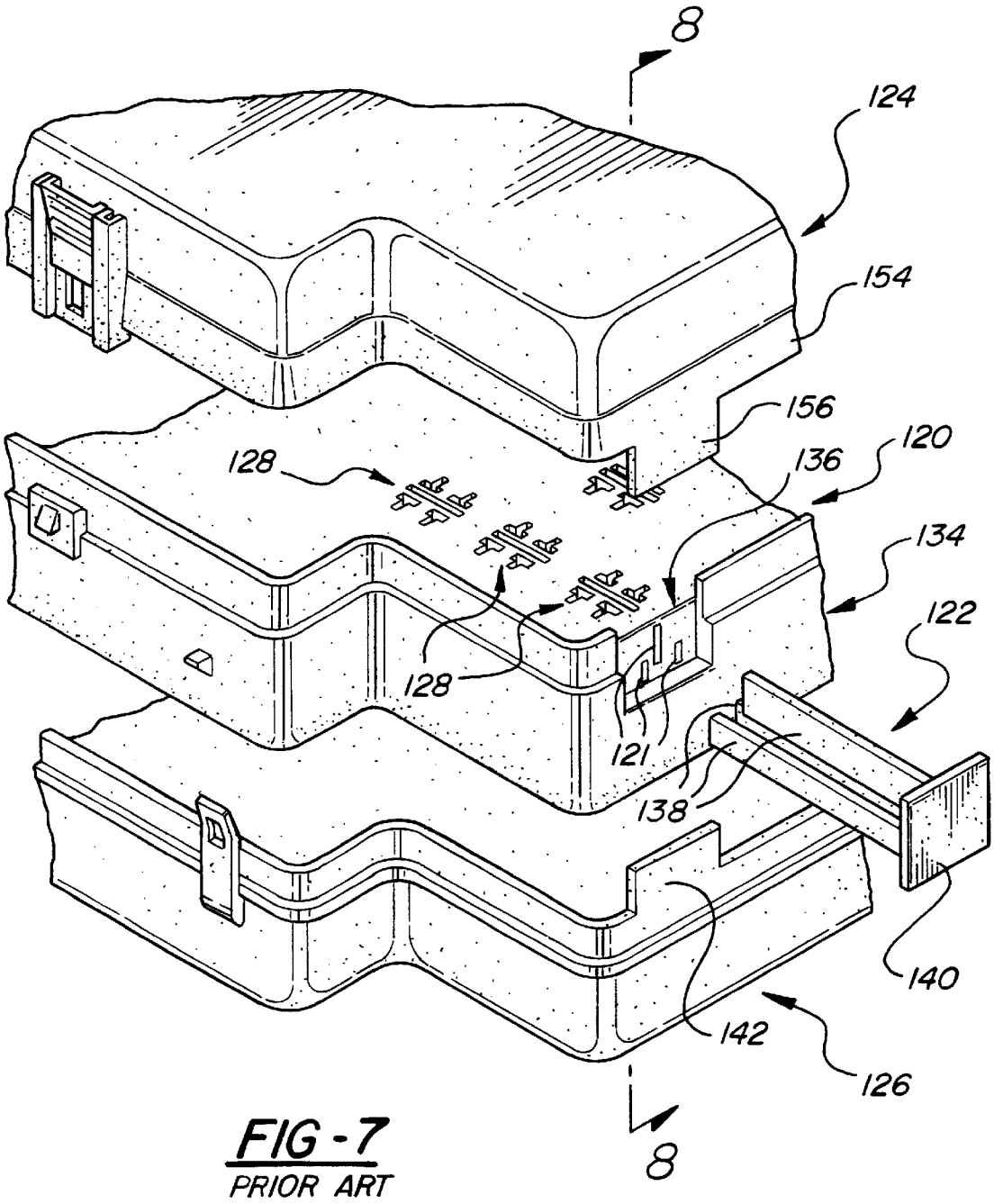
FIG-7 PRIOR ART
FIG. 7 is a perspective view of a prior art power distribution center before assembly.

The junction block 12 has an upper surface 20 with a plurality of receptacles 22 formed therein for receiving the terminal blades of electrical components (not shown) such as fuses, relays, electrical connectors, etc. A junction block 12 such as that considered herein usually has receptacles 22 substantially covering its upper surface 20, but for clarity only four receptacles, three of which are disposed in a straight line, are shown in FIG. 1. Walls 24 molded integrally with the junction block 12 define chambers 26 disposed immediately below the upper surface 20, in a configuration substantially identical to the structure of the prior art junction block shown in FIGS. 7 and 8. Electrical terminals 27 are disposed within the chambers 26 to make electrical contact with the terminal blades of the electrical components when the blades are inserted downwardly through the receptacle 22 openings into the chambers 26.

A side wall 28 extends downwardly from the upper surface 20 of the junction block 12. The side wall 28 comprises a substantially flat lower section **28*a* and an upper section 28*b* which is inset slightly from the lower section 28*a* to form a step 30. The upper section 28*b* of the side wall 28 immediately adjacent the upper surface 20 of the junction block 12 forms a lip or rim 32 extending a short distance above the plane of the upper surface 20**.

Upper latch projections 34 (only one of which is visible in FIG. 1) are molded integrally with the side wall 28 adjacent the upper edge thereof on opposite sides of the junction block 12. Similarly, lower latch projections 36 are molded integrally with the junction block 12 adjacent the lower edge of the side wall 28 at a number of locations around the periphery thereof.

A rectangular gap 38 is formed in the side wall 28, extending downwardly from the upper edge thereof adjacent the end of the line of receptacles 22. An offset wall 40 is disposed within the gap 38 and is recessed inwardly from the surface of the side wall 28 by a small distance. Three passages 42 extend from the offset wall 40 into the junction block 12 and into communication with chambers 26.

The upper housing 14 has an outwardly flared skirt 44 forming its lower edge, and upper latch tabs 46 (only one of which is shown) extend downwardly from the skirt 44 on opposite sides of the housing in positions coinciding with the locations of the upper latch projections 34. The lower housing 16 likewise has latch tabs 48 at two or more locations around its periphery in positions coinciding with the lower latch projections 36. A ridge 50 protrudes outwardly from the surface of the lower housing 16 a short distance below the upper edge and extends around the periphery thereof.

The terminal holder 18 comprises a rectangular end plate 52 and three arms 54 projecting from one face thereof. The arms 54 are of a size and configuration matching that of the passages 42. The end plate 52 has an upper portion 56 and a lower portion 58 which are substantially parallel to and offset from one another and connected by a short step 60 on the face opposite from the arms.

The terminal holder 18 is inserted into engagement with the junction block 12 by sliding the arms 54 into the passages 42. When the terminal holder 18 is fully inserted, the arms 54 project into the chambers 26 to retain the terminals 27 therein in a manner substantially identical to that described hereinabove in relation to the prior art junction block 12 and shown in FIGS. 7 and 8.

The offset wall 40 is recessed inwardly from the surface of the side wall 28 by the correct distance such that when the terminal holder arms 54 are fully inserted into the passages 42 and the end plate 52 butts up against the offset wall 40, the outer surfaces of the end plate 52 fit flush with the surfaces of the side wall 28. The upper portion 56 of the end plate 52 fits flush with the upper section 28*b* of the side wall 28, the lower portion 58 of the end plate 52 fits flush with lower section 28*a* of the side wall 28, and the step 60 in the end plate 52 is aligned with the step 30 separating the upper and lower sections of the side wall 28.

After the terminal holder 18 has been inserted fully into the junction block 12 such that the end plate 52 is flush with the side wall 28, the upper housing 14 is placed over the upper surface 20 such that the skirt 44 fits downwardly over and surrounds the upper edge of the side wall 28 and the upper portion 56 of the end plate 52. The latch tabs 46 are then snapped into engagement with their respective latch projections 34 to secure the upper housing 14 to the junction block 12. The upper edge of the lower housing 16 fits inside of the perimeter of the lower edge of the junction block 12 as deeply as is permitted by ridge 50, and the lower latch tabs 48 are snapped into engagement with the lower latch projections 36 to secure the lower housing 16 and junction block 12 together.

As is apparent from the above description, the present invention provides an effective and structurally simple means for inhibiting the intrusion of contamination into the passages which receive the terminal holder arms. Because the end plate of the terminal holder fits flushly with the outer surface of the junction block, the housings need not have any tabs or other features which may complicate fabrication and assembly of the PDC.

The invention claimed is:

1. A power distribution center comprising:

a junction block having an upper surface with a plurality of receptacles formed therein for receiving electrical components, a side wall extending from the upper surface and having an upper section and a lower section in offset, substantially parallel relationship and joined by a step, a gap in the side wall adjacent the upper surface and at least one passage extending from the gap into the junction block;

a plurality of terminals disposed within the junction block for making electrical connection with the electrical components when the components are inserted into respective receptacles;

a holder for retaining the terminals within the junction block and having at least one arm insertable into the at least one passage and an end plate joined to the at least one arm and comprising an upper portion and a lower portion in offset, substantially parallel relationship to one another and joined by a second step, the side wall upper section and the end plate upper portion fitting into coplanar relationship with one another and the side wall lower section and the end plate lower portion fitting into coplanar relationship with one another when the at least one arm is inserted into the at least one passage; and an upper housing attachable to the junction block to shield the upper surface, the upper housing fitting around the side wall upper section and covering the end plate upper portion.

2. The power distribution center according to claim 1 wherein an offset wall is disposed within the gap, the offset wall being recessed inwardly from the side wall and the at least one passage opening onto the offset wall.

3. The power distribution center according to claim 1 wherein the side wall upper section forms a lip extending above the junction block upper surface and the end plate upper portion forms a continuation of the lip when the end plate is in the gap.

4. The power distribution center according to claim 1 further comprising a lower housing for shielding a lower surface of the junction block.

5. The power distribution center according to claim 1 wherein the upper and lower end plate sections are offset by an amount generally equal to a thickness of a wall of the upper housing, whereby the wall of the upper housing is substantially flush with the lower section of the end plate when the housing is attached to the junction block.

* * * * *

UNITED STATES PATENT AND TRADEMARK OFFICE

CERTIFICATE OF CORRECTION

PATENT NO : 6,045,412

DATED : April 4, 2000

INVENTOR(S) : Guanco and Umemoto

It is certified that error appears in the above-identified patent and that said Letters Patent is hereby corrected as shown below:

Column 2, line 39 - delete "," (second occurrence);

Column 3, line 65 - delete "unction" and insert --junction--

Signed and Sealed this

Sixth Day of March, 2001

*Attest:*

Nicholas P. Godici

NICHOLAS P. GODICI

*Attesting Officer*

*Acting Director of the United States Patent and Trademark Office*